United States Patent [19]

Pai et al.

[11] Patent Number: 4,666,806

[45] Date of Patent: May 19, 1987

[54] OVERCOATED AMORPHOUS SILICON IMAGING MEMBERS

[75] Inventors: Damodar M. Pai, Fairport; Edwin R. Kuhn, Rochester, both of N.Y.

[73] Assignee: Xerox Corporation, Stamford, Conn.

[21] Appl. No.: 781,858

[22] Filed: Sep. 30, 1985

[51] Int. Cl.[4] ..... G03G 5/14

[52] U.S. Cl. ..... 430/57; 430/66; 430/84

[58] Field of Search ..... 430/57, 65, 66, 84, 430/95

[56] References Cited

U.S. PATENT DOCUMENTS

| | | | |
|---|---|---|---|
| 4,394,426 | 7/1983 | Shimizu et al. | 430/66 |
| 4,460,669 | 7/1984 | Ogawa et al. | 430/57 |
| 4,465,750 | 8/1984 | Ogawa et al. | 430/57 |
| 4,525,442 | 6/1985 | Shirai et al. | 430/65 |
| 4,544,617 | 10/1985 | Mort et al. | 430/66 |

*Primary Examiner*—John L. Goodrow

*Attorney, Agent, or Firm*—E. O. Pagano

[57] ABSTRACT

Disclosed is an electrostatographic imaging member comprised of a supporting substrate, a blocking layer of hydrogenated amorphous silicon with dopants, a hydrogenated amorphous silicon photoconducting layer with dopants, and in contact therewith a top overcoating layer of nonstoichiometric silicon nitride with from between 67 to 95 atomic percent of silicon, and from between 33 to 5 atomic percent of nitrogen.

34 Claims, 3 Drawing Figures

OVERCOATED AMORPHOUS SILICON IMAGING MEMBERS

BACKGROUND OF THE INVENTION

This invention is generally directed to amorphous silicon imaging members; and more specifically, the present invention is directed to layered photoresponsive imaging members, or devices comprised of hydrogenated amorphous silicon and overcoating layers of certain nonstoichiometric silicon itrides. In one embodiment of the present invention, there is provided a layered photoresponsive imaging member comprised of a supporting substrate, a blocking layer of hydrogenated amorphous silicon with dopants therein, a bulk photoconducting layer of hydrogenated amorphous silicon with dopants therein, and in contact therewith an overcoating layer of silicon nitride containing in a specific amount an excess of silicon. Further, in another specific embodiment of the present invention there is provided a layered photoresponsive imaging member comprised of a supporting substrate, a blocking layer of hydrogenated amorphous silicon with high, for example about 100 parts per million concentration of boron therein, a bulk photoconducting layer of hydrogenated amorphous silicon with minor amounts of boron therein, for example 3 parts per million; and in contact therewith an overcoating layer of silicon nitride with an excess of silicon. These imaging members can be incorporated into electrophotographic; and in particular xerographic imaging and printing systems wherein, for example, the latent electrostatic patterns which are formed can be developed into images of high quality and excellent resolution. Moreover, the members of the present invention possess high charge acceptance values, in excess of 40 volts/micron for example; and further these members can be of a very desirable thickness from, for example about 100 microns or less. Also, the imaging members of the present invention have desirable low dark decay properties enabling them to be very useful in xerographic imaging processes. In these processes, latent electrostatic images are formed on the devices involved followed by development, transfer and fixing. Additionally, the photoresponsive imaging members of the present invention when incorporated into xerographic imaging and printing systems are insensitive to humidity and corona ions generated permitting the formation of acceptable images of high resolution for an extended number of imaging cycles. Also, the imaging members of the present invention enable the elimination of undesirable lateral movement of charges at the interface between the photoconducting layer and the overcoating layer as a result of band bending, a prior art problem, and thus permitting images with increased resolution and less print deletions.

Electrostatographic imaging, particularly xerographic imaging processes, are well known, and are extensively described in the prior art. In these processes a photoresponsive or photoconductor material is selected for forming the latent electrostatic image thereon. The photoreceptor is generally comprised of a conductive substrate containing on its surface a layer of photoconductive material; and in many instances, a thin barrier layer is situated therebetween to prevent charge injection from the substrate, which could adversely affect the quality of the resulting image. Examples of known useful photoconductive materials include amorphous selenium, alloys of selenium such as selenium-tellurium, selenium-arsenic, and the like. Additionally, there can be selected as the photoresponsive imaging member various organic photoconductive materials including, for example, complexes of trinitrofluorenone and polyvinylcarbazole. Recently there has been disclosed layered organic photoresponsive devices with aryl amine hole transporting molecules, and photogenerating layers, reference U.S. Pat. No. 4,265,990, the disclosure of which is totally incorporated herein by reference.

Also known are amorphous silicon photoconductors, reference for example U.S. Pat. Nos. 4,265,991 and 4,225,222. There is disclosed in the '991 patent an electrophotographic photosensitive member comprised of a substrate, and a photoconductive overlayer of amorphous silicon containing 10 to 40 atomic percent of hydrogen and having a thickness of 5 to 80 microns. Additionally, this patent describes several processes for preparing amorphous silicon. In one process embodiment, there is prepared an electrophotographic photosensitive member by heating the member present in a chamber to a temperature of 50° C. to 350° C., introducing a gas with silicon and hydrogen atoms, providing an electrical discharge in the chamber by electric energy to ionize the gas, followed by depositing amorphous silicon on an electrophotographic substrate at a rate of 0.5 to 100 Angstroms per second by utilizing an electric discharge thereby resulting in an amorphous silicon photoconductive layer of a predetermined thickness. Although the amorphous silicon device described in this patent is photosensitive, after a minimum number of imaging cycles, less than about 1,000 for example, unacceptable low quality images of poor resolution with many deletions may result. With further cycling, that is subsequent to 1,000 imaging cycles and after 10,000 imaging cycles, the image quality may continue to deteriorate often until images are partially deleted.

Further, there is disclosed in the prior art amorphous silicon photoreceptor imaging members containing, for example, stoichiometric silicon nitride overcoatings; however, these members in some instances generate prints of low resolution as a result of the band bending phenomena. Additionally, with the aforementioned silicon nitride overcoatings, the resolution loss can in many instances be extreme thereby preventing, for example, any image formation whatsoever.

There are also illustrated in copending applications photoconductive imaging members comprised of amorphous silicon. Accordingly, for example, there is illustrated in copending application U.S. Ser. No. 695,990, entitled Electrophotographic Devices Containing Compensated Amorphous Silicon Compositions, the disclosure of which is totally incorporated herein by reference, an imaging member comprised of a supporting substrate and an amorphous hydrogenated silicon composition containing from about 25 parts per million by weight to about 1 percent by weight of boron compensated with substantially equal amounts of phosphorous. Furthermore, described in copending application U.S. Pat. No. 4,544,617 entitled Electrophotographic Devices Containing Overcoated Amorphous Silicon Compositions, the disclosure of which is totally incorporated herein by reference, are imaging members comprised of a supporting substrate, an amorphous silicon layer, a trapping layer comprised of doped amorphous silicon, and a top overcoating layer of stoichiometric silicon nitrides. More specifically, there is disclosed in this copending application an imaging member comprised of a supporting substrate, a carrier transport layer comprised of uncompensated or undoped amorphous silicon; or amorphous silicon slightly doped with p or n type dopants such as boron or phosphorous, a thin trapping layer comprised of amorphous silicon which is heavily doped with p or n type dopants such as boron or phosphorous; and a top overcoating layer of specific stoichiometric silicon nitride, silicon carbide, or amorphous carbon. However, one disadvantage with this imaging member is that the trapping layer introduces a dark decay component which reduces the charge acceptance for the imaging member.

Additionally, described in copending application U.S. Pat. No. 4,613,556 entitled Heterogeneous Electrophotographic Imaging Members of Amorphous Silicon, the disclosure of which is totally incorporated herein by reference, are imaging members comprised of hydrogenated amorphous silicon photogenerating compositions, and a charge transporting layer of plasma deposited silicon oxide.

Other representative prior art disclosing amorphous silicon imaging members, including those with overcoatings, are U.S. Pat. Nos. 4,460,669; 4,465,750; 4,394,426; 4,394,425; 4,409,308; 4,414,319; 4,443,529; 4,452,874; 4,452,875; 4,483,911; 4,359,512; 4,403,026; 4,416,962; 4,423,133; 4,460,670; 4,461,820; 4,484,809; and 4,490,453. Additionally, patents that may be of background interest with respect to amorphous silicon photoreceptor members include, for example, 4,359,512; 4,377,628; 4,420,546; 4,471,042; 4,477,549; 4,486,521; and 4,490,454.

Further, additional representative prior art patents that disclose amorphous silicon imaging members include, for example, U.S. Pat. No. 4,357,179 directed to methods for preparing imaging members containing high density amorphous silicon or germanium; U.S. Pat. No. 4,237,501 which discloses a method for preparing hydrogenated amorphous silicon wherein ammonia is introduced into a reaction chamber; U.S. Pat. Nos. 4,359,514; 4,404,076; 4,403,026; 4,397,933; 4,423,133; 4,461,819, 4,237,151; 4,356,246; 4,361,638; 4,365,013; 3,160,521; 3,160,522; 3,496,037; 4,394,426; and 3,892,650. Of specific interest are the amorphous silicon photoreceptors illustrated in U.S. Pat. Nos. 4,394,425; 4,394,426 and 4,409,308 wherein overcoatings such as silicon nitride and silicon carbide are selected. Examples of silicon nitride overcoatings include those with a nitrogen content of from about 43 to about 60 atomic percent.

Additionally, processes for depositing large area defect free films of amorphous silicon by the glow discharge of silane gases are described in Chittick et al., the Journal of the Electrochemical Society, Volume 116, Page 77, (1969). Further, the fabrication and optimization of substrate temperatures during amorphous silicon fabrication is illustrated by Walter Spear, the Fifth International Conference on Amorphous and Liquid Semiconductors presented at Garmisch Partenkirchen, West Germany in 1963. Other silicon fabrication processes are described in the Journal of Noncrystalline Solids, Volumes 8 to 10, Page 727, (1972), and the Journal of Noncrystalline Solids, Volume 13, Page 55, (1973).

Although the above described amorphous silicon photoresponsive members, particularly those disclosed in the copending applications, are suitable, in most instances, for their intended purposes there continues to be a need for improved members comprised of amorphous silicon which can be easily fabricated. Additionally, there is a need for amorphous silicon imaging members that possess desirable high charge acceptance values and low charge loss characteristics in the dark. Furthermore, there continues to be a need for improved amorphous silicon imaging members with overcoating layers of specific nonstoichiometric silicon nitrides enabling the substantial elimination of the undesirable lateral motion of charge, and thereby allowing for the generation of images of increased resolution when compared to amorphous silicon imaging members with other overcoatings of silicon nitride. Additionally, there is a need for improved layered imaging members of amorphous silicon which are humidity insensitive and are not adversely effected by electrical consequences resulting from scratching and abrasion. There is also a need for amorphous silicon imaging members which can be selected for use in repetitive imaging and printing systems. Furthermore, there is a need for amorphous silicon imaging members with low surface potential decay rates in the dark, and photosensitivity in the visible and near visible wavelength range. Further, there is a need for improved layered amorphous silicon imaging members which have very few image defects such as white spots with images of dark solids.

SUMMARY OF THE INVENTION

It is therefore an object of the present invention to provide photoresponsive imaging members with high charge acceptance and low dark decay characteristics.

In another object of the present invention there are provided layered imaging members comprised of amorphous silicon with overcoatings of specific nonstoichiometric silicon nitrides.

Also, in a further object of the present invention there are provided layered photoconductive imaging members comprised of blocking layers of doped amorphous silicon, and overcoatings of specific nonstoichiometric silicon nitrides.

In yet another object of the present invention there are provided layered photoresponsive imaging members which are rendered photosensitive in the near infrared by suitable alloying of the amorphous silicon photoconductor layer with germanium and tin, or compositions derivable from carbon and germanium.

Another object of the present invention resides in layered imaging members comprised of amorphous silicon with overcoatings of specific nonstoichiometric silicon nitrides wherein there is substantially eliminated the lateral motion of charge at the interface of the photoconducting layer, and the overcoating thereby reducing blurring and providing images of increased resolution.

In another object of the present invention there are provided imaging and printing processes with layered imaging members comprised of supporting substrates, photoconductive hydrogenated amorphous silicon with overcoatings of certain nonstoichiometric silicon nitrides permitting the substantial elimination of the lateral motion of charge at the interface of the photoconducting layer and the overcoating thereby reducing blurring, and providing images of increased resolution.

In a further object of the present invention there are provided layered photoresponsive imaging members with overcoatings of specific nonstoichiometric silicon nitrides wherein image defects such as white spots are substantially eliminated.

These and other objects of the present invention are accomplished by the provision of an overcoated amorphous silicon photoresponsive imaging member. More specifically, in accordance with the present invention there are provided layered photoresponsive imaging members comprised of a supporting substrate; a blocking layer of doped amorphous silicon; a bulk photoconductive layer of amorphous silicon; and a top overcoating layer of specific nonstoichiometric silicon nitrides, with from between 67 to 95 atomic percent of silicon, and from between 33 to 5 atomic percent of nitrogen. In one specific embodiment of the present invention there is provided a photoresponsive imaging member comprised of a supporting substrate; a blocking layer of amorphous silicon with about 100 parts per million of boron; a photoconducting layer of amorphous silicon with about 3 parts per million of boron, and a top protective overcoating layer of nonstoichiometric silicon nitride containing an excess of silicon, that is, from between 67 to 95 atomic percent of silicon.

The photoresponsive or photoconductive members of the present invention can be incorporated into various imaging apparatuses wherein, for example, latent electrostatic images are formed followed by development, subsequently transferring the developed image to a suitable substrate; and optionally permanently affixing the image thereto. Moreover, the photoconductive imaging members of the present invention, in certain configurations, can be selected for use in xerographic printing processes, that is for example, when the member includes therein a component which is sensitive to the infrared region of the spectrum. Also, the photoresponsive imaging members of the present invention can be incorporated into imaging apparatuses wherein there is selected for rendering the images visible a liquid development process. The photoresponsive imaging members of the present invention, when incorporated into xerographic imaging processes, possess high charge acceptances of, for example, 40 volts per micron or greater; have very low dark decay characteristics, 100 volts per second; and can be fabricated with the desirable properties and thicknesses of 100 microns or less. Also, the photoconductive members of the present invention enable the generation of images with increased resolution as a result of the elimination of the lateral movement of charge at the interface of the overcoating layer. Furthermore, the use of the imaging members of the present invention enable the generation of images with substantially no white spots.

Specifically therefore, the photoresponsive members of the present invention can be incorporated into xerographic printing and imaging apparatuses, inclusive of those with solid state lasers or electroluminescent light sources as these members can be rendered sufficiently sensitive to wavelengths of up to 7800 Angstroms when the photoconducting layer is suitably alloyed with germanium or tin; or fabricated from germanium-carbon alloys. Also, the photoresponsive imaging members of the present invention when in use are substantially insensitive to humidity conditions, and corona ions generated from corona charging devices enabling these members to generate acceptable images of high resolution for an extended number of imaging cycles exceeding, in most instances, 100,000.

BRIEF DESCRIPTION OF THE DRAWINGS

For a better understanding of the present invention and further features thereof reference is made to the following description of the preferred embodiments wherein.

Figure 1:
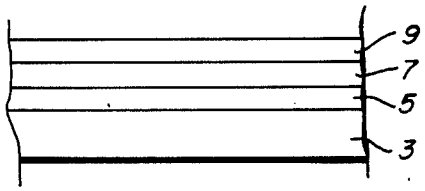
FIG. 1 is a partially schematic cross-sectional view of the photoresponsive imaging member of the present invention.

Illustrated in FIG. 1 is a photoresponsive imaging member of the present invention comprised of a supporting substrate 3, a blocking layer 5 in a thickness of from about 0.02 to about 1 micron of hydrogenated amorphous silicon with dopants; a photoconductive layer of hydrogenated amorphous silicon 7 of a thickness of from about 2 to about 100 microns; and a transparent nonstoichiometric silicon nitride top overcoating layer 9 of a thickness of from about 0.05 to about 2 microns, with from between 67 to 95 atomic percent silicon.

Figure 2:
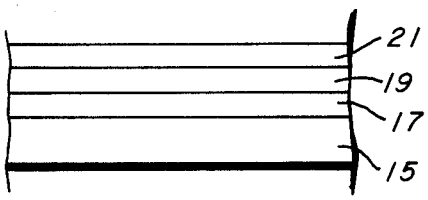
FIG. 2 is a partially schematic cross-sectional view of a further photoresponsive imaging member of the present invention.

Illustrated in FIG. 2 is a photoresponsive imaging member of the present invention comprised of a supporting substrate 15; a blocking layer 17 of hydrogenated amorphous silicon with about 100 parts per million of boron; a photoconducting layer of hydrogenated amorphous silicon 19 with about 3 parts per million of boron in a thickness of from about 2 microns to about 100 microns; and a top overcoating layer 21 in a thickness of about 0.2 micron of silicon nitride containing 69 atomic percent of silicon and 31 atomic percent of nitrogen.

Figure 3:
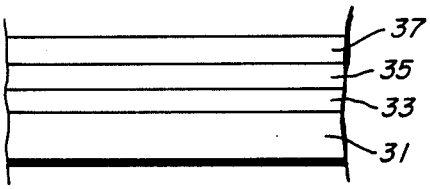
FIG. 3 is a partially schematic cross-sectional view of a prior art photoresponsive imaging member with overcoatings of silicon nitride.

Illustrated in FIG. 3 is a prior art photoresponsive imaging member comprised of a supporting substrate 31; a blocking layer 33 of hydrogenated amorphous silicon with about 100 parts per million of boron; a photoconducting layer of hydrogenated amorphous silicon 35 with about 3 parts per million boron of a thickness of from about 2 microns to about 100 microns; and a top overcoating layer 37 of silicon nitride with silicon, 50 atomic percent silicon, and 50 atomic percent nitrogen, reference Example II.

Inclusion of other elements such as germanium or tin in the hydrogenated amorphous silicon imaging members of the present invention can be accomplished by the simultaneous glow discharge of, for example, silane and germane or stanane. The alloying of silicon with germanium and/or tin is useful as the band gap of the alloy is smaller than that of the hydrogenated amorphous silicon itself thus permitting photoresponse to longer wavelengths. A thin layer of silicon and germanium can be introduced between the barrier and the photoconductive layer, or between the photoconducting and over-coating layers of FIGS. 1 and 2.

The supporting substrates for each of the imaging members illustrated in the Figures may be opaque or substantially transparent, thus this substrate can be comprised of numerous substances providing the objectives of the present invention are achieved. Specific examples of substrates are insulating materials such as inorganic or organic polymeric compositions; a layer of an organic or inorganic material having a semiconductive surface layer thereon, such as indium tin oxide; or a conductive material such as, for example, aluminum, chromium, nickel, brass, stainless steel, and the like. The substrate may be flexible or rigid and can have many different configurations such as, for example, a plate, a cylindrical drum, a scroll, an endless flexible belt, and the like. Preferably, the substrate is in the form of a cylindrical drum, or endless flexible belt. In some situations, it may be desirable to coat on the back of the substrate, particularly when the substrate is an organic polymeric material, an anticurl layer such as, for example, polycarbonate materials commercially available as Makrolon. The substrates are preferably comprised of aluminum, stainless steel sleeve, or an oxidized nickel composition.

Also, the thickness of the substrate layer depends on many factors including economical considerations, and required mechanical properties. Accordingly thus, this layer can be of a thickness of from about 0.01 inch (154 microns) to about 0.2 inch (5080 microns), and preferably is of a thickness of from about 0.05 inch (1270 microns) to about 0.15 inch (3810 microns). In one particularly preferred embodiment, the supporting substrate is comprised of oxidized nickel in a thickness of from about 1 mil to about 10 mils.

Blocking layers that may be selected are generally comprised of amorphous silicon having incorporated therein known p, or n dopants inclusive of boron and phosphorous. Specifically thus, for example, for p or i (intrinsic) doping of the bulk photoconductive layer, there is selected a p+ type barrier obtained by doping with a heavy concentration of boron; while for n type photoconductive properties, n+ type barriers are selected inclusive of those obtained by doping with phosphorous. The aforementioned dopants can be present in various amounts that will enable, for example, the trapping of the minority carriers injected from the substrates, which carriers are of an opposite sign or charge to that used for affecting discharge of the photoresponsive imaging member. Generally, however, from about 50 parts per million to about 500 parts per million of dopant is present in the blocking layer. The blocking layer is of a thickness of from about 0.01 micron to about 1 micron.

Illustrative examples of materials selected for the photoconducting layer are hydrogenated amorphous silicon, preferably with 10 to 40 atomic percent of hydrogen, especially amorphous silicon as described in the copending applications referred to hereinbefore. Also, particularly useful as photoconducting material is amorphous silicon compensated with boron and phosphorous, reference copending application U.S. Ser. No. 695,990, the disclosure of which has been incorporated herein by reference. More specifically, as indicated herein there is disclosed in this copending application an amorphous silicon composition with from about 25 parts per million by weight to about 1 weight percent of boron compensated with from about 25 parts per million by weight to about 1 weight percent of phosphorous. Preferably, the photoconducting bulk layer is comprised of hydrogenated amorphous silicon doped with from about 1 part per million to about 20 parts per million of boron. These dopants permit a reduction in the dark conductivity of the resulting member.

An important layer with respect to the imaging members of the present invention is the top overcoating layer of nonstoichiometric silicon nitride with a certain excess of silicon. More specifically, the atomic ratio of nitrogen to silicon in the overcoating should be less than 0.5, that is, less than 33 atomic percent of nitrogen as illustrated hereinbefore. This provides for increases in the resolution of the generated images in view of the elimination of the lateral movement of charges at the interface between the photoconducting layer and the overcoating layer. With overcoatings of silicon nitride, where the atomic ratio of nitrogen to silicon is 1.33, 43 atomic percent silicon, 57 atomic percent nitrogen, the image resolution is substantially zero as a result of the lateral motion of charges.

Although it is not desired to be limited by theory, it is believed that the band gap of $SiN_x$ varies continuously from 1.6 to in excess of 4.0 electron volts as the nitrogen content, x, is increased from 0 to 1.33. In those situations where x is of a small value, that is a number of from about 0.05 to about 0.5, the difference in band gaps between the photoconductive layer of the amorphous silicon imaging member doped with small concentrations of boron and the overcoating layer of FIG. 2, is low, less than 0.5 electron volts for example. Therefore, in an imaging sequence the photoresponsive imaging member of FIG. 2 is first charged to a positive polarity with a corotron, followed by imagewise exposure wherein the photogenerated holes formulated are injected into the bulk layer and transit to the substrate. It is believed that the photogenerated electrons are injected into and transported through the overcoat layer of silicon nitride, wherein the value of x is from 0.05 to about 0.5. Thereafter, the latent image patterns are developed with toner particles thus providing images with high resolution, that is, no background deposits or substantially an absence of white spots. In contrast, with prior art photoresponsive imaging members the difference in band gap is greater than about 2.4 electron volts between the photoconductive layer doped with small quantities of boron and the overcoating layer of silicon nitride, $SiN_x$ wherein x is a number of from 0.8 to 1.5. Therefore, in the process of generating images with the aforementioned photoresponsive imaging member of FIG. 3, it is initially charged to a positive polarity with a corotron, and subsequently imagewise exposed. This causes photogenerated holes to be injected into the bulk of the imaging member and transit to the substrate; however, as a result of the mismatching (large difference in band gap) of the band gap between the photoconductive and overcoating layer, more than 2.4 electron volts, the photogenerated electrons remain behind, that is, they are present in the photoconductive layer. It is believed that the presence of these electrons causes a band bending phenomenon which results in lateral migration of the charge thus destroying the charge pattern of the latent image and providing a reduction in the resolution of the final developed image generated. Accordingly, when this latent image is developed with toner particles, there results no images whatsoever; or images of very poor resolution.

Imaging members of the present invention can be prepared in accordance with the processes as described in the copending applications referred to hereinbefore. More specifically, thus the imaging members of the present invention can be prepared by simultaneously introducing into a reaction chamber a silane gas often in combination with other gases for the purpose of doping or alloying, followed by the introduction of more silane gas and ammonia. In one specific embodiment, the process of preparation involves providing a receptacle containing therein a first substrate electrode means, and a second counterelectrode means providing a cylindrical surface on the first electrode means, heating the cylindrical surface with heating elements contained in the first electrode means while causing the first electrode means to axially rotate, introducing into the reaction vessel a source of silicon containing gas often in combination with other dilluting, doping or alloying gases at a right angle with respect to the cylindrical member, applying an rf voltage on the second electrode with the first electrode grounded whereby the silane gas is decomposed resulting in the deposition of hydrogenated amorphous silicon or doped hydrogenated amorphous silicon on the cylindrical member. Thereafter, there is introduced into the reaction chamber further silane gas enabling the formation of the bulk photoconducting layer, followed by the introduction of a mixture of silane gas and ammonia. The atomic percent of silicon and nitrogen in the overcoating is dependent on the ratio of gases introduced into the chamber. Also, the total flow rates of the gases are maintained at between 50 and 400 sccm, and the gas mixture pressure is held at a constant 250 to 1,000 milliTorr. Also, the radio frequency electrical power density rf is between 0.01 and 1 W/cm$^2$ of electrode area, and the substrate temperature during the deposition process can be between 100°0 and 300° C.

Specifically therefore, the amorphous silicon photoconducting layer can be deposited by the glow discharge decomposition of a silane gas alone, or decomposition in the presence of small amounts of dopant gases such as diborane and/or phosphine. The range of useful flow rates, radio frequency power levels and reactor pressures are approximately the same as that described in the copending applications referred to herein. Specifically, the rates are 200 sccm of silane, and 6 sccm of 200 parts per million diborane doped silane. The specific pressure is 850 mTorr, and the total rf power of 100 watts.

This invention will now be described in detail with respect to specific preferred embodiments thereof, it being understood that these examples are intended to be illustrative only. The invention is not intended to be limited to the materials, conditions or process parameters recited herein. All parts and percentages are by weight unless otherwise indicated.

With respect to the examples that follow, unless otherwise indicated the boron doped hydrogenated amorphous silicon and overcoating layers of silicon nitride were fabricated in a stainless steel reactor with the gas composition, pressure, rf power, time of deposition, and other parameters as detailed. Also, there were selected as the supporting substrates aluminum drums of two sizes, one with an outer diameter of 84 millimeters, and a length of 400 millimeters while the other is 84 millimeters outer diameter, with a length of 335 millimeters. These drums were mounted in a stainless steel vacuum reactor, followed by rotating and heating to a temperature of 210° C. Thereafter, the reactor was evacuated by applying a vacuum thereto, and the appropriate gases were introduced into the stainless steel reaction chamber with flow meters and flow valves. Throttle valves are selected to adjust the pressure. Further, the fabrication was accomplished by rf (13.6 megacyles) plasma decomposition of the gases illustrated. A capacitively coupled configuration was selected by grounding the drum and utilizing a large concentric static electrode as the rf electrode. Subsequent to fabrication of the appropriate layers, argon was passed through the reactor while the supporting substrate drum was being simultaneously cooled.

The amorphous silicon photoreceptor members prepared were then tested in a standard scanner for the purpose of determining the photoconductive characteristics thereof. The scanner is an apparatus in which there is provision for mounting and rotating the drum along its axis. Charging corotron exposure, erase lamps, and voltage measuring probes are mounted along the circumference. This testing was affected by permitting the scanner to operate at a surface speed of 20 revolutions per minute, and subjecting the photoreceptor to a positive polarity of 7,000 volts corona potential with a 10 centimeter long corotron. Thereafter, the dark decay and the light induced decay of the potentials were measured by a series of electrical probes mounted along the circumference of the photoreceptor. The scanner results indicate the charging capabilities of the photoreceptor structure, that is, dark decay values; and the discharge characteristics of the photoreceptor when subjected to light illumination. Additionally, each of the photoreceptor members prepared in the examples was print tested in a Xerox Corporation 3100® or 2830® copying apparatus. The aforementioned print testing can be used to determine the resolution capabilities of the photoreceptors prepared.

EXAMPLE I

A three layer hydrogenated amorphous silicon photoreceptor was fabricated on an aluminum drum with a length of 400 millimeters by introducing into a reaction chamber 200 sccm of a silane gas doped with 100 parts per million of diborane, the full apparatus and process conditions being as illustrated in U.S. Pat. No. 4,466,380, the disclosure of which totally incorporated herein by reference. The throttle present on the reactor was adjusted to obtain a plasma pressure in the reaction vessel of 375 microns while the rf power was maintained at 160 watts. A blocking barrier layer or first layer consisting of hydrogenated amorphous silicon doped with 100 parts per million of boron in a thickness of 5,000 Angstroms was deposited on the aluminum drum after 5 minutes.

Subsequently, the bulk or second layer is applied to the blocking layer by introducing into the reaction chamber 200 sccm of silane gas and 6 sccm of silane gas doped with 100 parts per million of diborane. The plasma pressure in the chamber was maintained at 800 microns, the rf power was 100 watts, and the deposition time was 180 minutes. There resulted in a thickness of 17 microns a bulk photoconductive layer consisting of hydrogenated amorphous silicon doped with 3 parts per million of boron.

Thereafter, there was applied to the bulk layer an overcoating of near stoichiometric silicon nitride by introducing into the reaction chamber 20 sccm of the silane gas and 190 sccm of ammonia. The plasma pressure in the reaction chamber was maintained at 325 microns, the rf power was set at 50 watts, and the deposition was completed in 3 minutes. There resulted in a thickness of 0.05 micron a silicon nitride overcoat with a nitrogen to silicon atomic ratio of 1.0, 50 atomic percent of nitrogen. The amount of nitrogen present was confirmed by the preparation of a silicon nitride film on the aluminum substrate by flowing into the reaction chamber 20 sccm of silane gas and 190 sccm of ammonia. The plasma pressure was maintained at 325 microns and the rf power was set at 50 watts. The film was analyzed by electron spectroscopy for chemical analysis (ESCA) technique. The nitrogen to silicon atomic ratio was found to be 1.0, 50 atomic percent of nitrogen.

Testing of this photoreceptive member in the scanner described herein indicated that a current of 40 microamps emitted from a corotron wire causes the photoreceptor to charge to 525 volts. Additionally, this photoreceptor had a dark decay rate of 100 volts per second, and further the voltage of 525 was completely discharged by a light source of less than 20 ergs/cm$^2$. This data indicates that the photoconductor possesses good photoconductive properties; however, when this imaging member was print tested in a Xerox Corporation model 3100® copier, there were generated prints of substantially zero resolution; that is, the images were blurry and could not be read.

EXAMPLE II

A three layer photoresponsive imaging member was prepared by repeating the procedure of Example I with the exception that the top overcoating layer was fabricated by flowing 45 sccm of silane gas and 150 sccm of ammonia; and wherein the throttle was adjusted to obtain a plasma pressure of 308 microns, with an rf power of 40 watts and a plasma deposition time of 4 minutes. There resulted an overcoating layer of silicon nitride in a thickness of 0.05 micron with a nitrogen to silicon atomic ratio of 0.75, 43 atomic percent of nitrogen. The amount of nitrogen present was confirmed by the preparation of a silicon nitride film on the aluminum substrate by flowing into the chamber 45 sccm of silane gas and 150 sccm of ammonia. The throttle was adjusted to obtain a plasma pressure of 308 microns, and the rf power was set at 40 watts. The nitrogen to silicon atomic ratio as determined by ESCA was found to be 0.75, 43 atomic percent of nitrogen.

The photoresponsive imaging member prepared had a charge acceptance of 525 volts, and a dark decay of 100 volts/sec. The light required to completely discharge this member was 20 ergs/cm$^2$. When this imaging member was print tested in the Xerox Corporation model 3100®, there resulted prints of substantially zero resolution; that is, the prints were unreadable.

EXAMPLE III

A three layer photoresponsive imaging member was prepared by repeating the procedure of Example I with the exception that the silicon nitride overcoating was generated by flowing 86 sccm of the silane gas and 114 sccm of ammonia. Further, the plasma pressure was maintained at 300 microns, the rf power selected was 40 watts, and the deposition time for the overcoating was 4 minutes. There resulted in a thickness of 0.05 microns an overcoating of silicon nitride with an excess of silicon, that is, a nitrogen to silicon atomic ratio of 0.45, or 31 atomic percent of nitrogen. The amount of nitrogen present was confirmed by the preparation of a silicon nitride film on the aluminum substrate by flowing 86 sccm of silane gas and 114 sccm of ammonia into the reaction chamber. The throttle was adjusted to obtain a pressure of 300 microns, and the rf power was set at 40 watts. The nitrogen to silicon atomic ratio was determined by ESCA to be 0.45, that is, 31 atomic percent of nitrogen.

Subsequently, the imaging member prepared was measured in the scanner and had a charge acceptance of 500 volts, and a dark decay of 100 volts/sec. The light intensity required to completely discharge was less than 200 ergs/cm$^2$. Additionally, when this imaging member was print tested in a Xerox Corporation 3100® machine, there were obtained, beginning with the first imaging cycle and continuing on for 5,000 imaging cycles, prints of excellent resolution, about 8 line pairs per millimeter; that is, the prints were not blurred and could be easily read.

EXAMPLE IV

Six photoresponsive three layer imaging members were then prepared by repeating the procedure of Example I with the exception that there was selected as the overcoating layer silicon nitride with varying atomic ratios of nitrogen to silicon. This was accomplished by varying the ammonia to silane gas ratio during the fabrication of the overcoating layers. The ammonia to silane gas ratio selected for these six members was 0.5, 1.33, 1.55, 2.0, 3,33 and 9.5, respectively. ESCA measurements confirmed the nitrogen to silicon atomic ratio in the overcoat layers to be 0.2, 0.45, 0.5, 0.6, 0.7 and 1.0; or 17, 31, 33, 38, 41, 50 atomic percent of nitrogen, respectively. The scanner measurements showed that the charge acceptance, dark decay and light sensitivities of all these members were essentially equivalent and similar to the values of the imaging member of Example I. Additionally, each photoresponsive imaging member was separately inserted into the Xerox Corporation 3100® apparatus for printing testing, and there resulted, using the first three members with overcoatings of nitrogen to silicon atomic ratios of 0.2, 0.45 and 0.5, images of excellent resolution equivalent to those obtained with the imaging member of Example III. Poor resolution prints were obtained when the fourth member with the silicon nitride (N/Si=0.6) overcoating was inserted and print tested in the 3100® machine. Prints of no resolution were obtained with the fifth and sixth members with silicon nitride overcoatings, nitrogen to silicon ratios of 0.7 and 1.0 respectively.

Although the invention has been described with reference to specific preferred embodiments, it is not intended to be limited thereto. Rather those of skill in the art will recognize that variations and modifications may be made therein which are included within the spirit of the present invention and within the scope of the following claims.

What is claimed is:

1. An electrostatographic imaging member comprised of a supporting substrate, a blocking layer of hydrogenated amorphous silicon with dopants, a hydrogenated amorphous silicon photoconducting layer with dopants, and in contact therewith a top overcoating layer of nonstoichiometric silicon nitride with from between 67 to 95 atomic percent of silicon, and from between 33 to 5 atomic percent of nitrogen.

2. An imaging member in accordance with claim 1 wherein the blocking layer is doped with boron or phosphorous.

3. An imaging member in accordance with claim 2 wherein the dopant is present in an amount of from about 50 parts per million to about 500 parts per million.

4. An imaging member in accordance with claim 1 wherein the amorphous silicon photoconducting layer contains dopants therein.

5. An imaging member in accordance with claim 4 wherein the dopant is boron present in an amount of from about 1 part per million to 20 parts per million.

6. An imaging member in accordance with claim 1 wherein the photoconducting layer is comprised of amorphous silicon simultaneously doped with boron and phosphorous in an amount of from about 2 parts per million to about 100 parts per million.

7. An imaging member in accordance with claim 1 wherein the photoconducting layer is comprised of an amorphous silicon-germanium alloy.

8. An imaging member in accordance with claim 1 wherein the photoconducting layer is comprised of an amorphous silicon-tin alloy.

9. An imaging member in accordance with claim 1 wherein the photoconducting layer is comprised of an amorphous carbon-germanium alloy.

10. An imaging member in accordance with claim 1 wherein the substrate is comprised of aluminum.

11. An imaging member in accordance with claim 1 wherein the substrate is a flexible belt.

12. An imaging member in accordance with claim 1 wherein the thickness of the photoconducting layer is from about 2 microns to about 100 microns.

13. An imaging member in accordance with claim 1 wherein the thickness of the overcoating layer is from about 0.05 micron to about 2 microns.

14. A method of imaging which comprises subjecting the photoresponsive imaging member of claim 1, to imagewise exposure, developing the resulting image with a toner composition, subsequently transferring the image to a suitable substrate, and optionally permanently affixing the image thereto.

15. A method of imaging in accordance with claim 14 wherein the photoconducting layer is comprised of amorphous silicon doped with boron or simultaneously with boron and phosphorous in an amount of from about 2 parts per million to about 100 parts per million.

16. A method of imaging in accordance with claim 14 wherein the amorphous silicon contains dopants therein.

17. A method of imaging in accordance with claim 14 wherein the photoconducting layer is comprised of an amorphous silicon-germanium alloy.

18. A method of imaging in accordance with claim 14 wherein the photoconducting layer is comprised of an silicon-tin alloy.

19. A method of imaging in accordance with claim 14 wherein the photoconducting layer is comprised of an amorphous carbon-germanium alloy.

20. A method of imaging in accordance with claim 14 wherein the thickness of the photoconducting layer is from about 2 microns to about 100 microns.

21. A method of imaging in accordance with claim 14 wherein the thickness of the overcoating layer is from about 0.05 micron to about 2.0 microns.

22. A method of imaging in accordance with claim 14 wherein the blocking layer is doped with boron.

23. A method of imaging in accordance with claim 14 wherein dopants in the blocking layer are present in an amount of from about 100 parts per million to about 500 parts per million.

24. A method of imaging in accordance with claim 14 wherein the substrate is comprised of aluminum.

25. A method of imaging in accordance with claim 14 wherein the substrate is a flexible belt.

26. A method of imaging in accordance with claim 14 wherein lateral movement of charges is eliminated at the interface of the overcoating layer, and the photoconducting layer enabling images with high resolution to be obtained.

27. An imaging member in accordance with claim 1 wherein from about 10 to about 40 atomic percent of hydrogen is present in the amorphous silicon.

28. An imaging member in accordance with claim 1 wherein there is present in the top overcoating layer from between 15 to 30 atomic percent of nitrogen, and from 85 to 70 atomic percent of silicon.

29. An electrostatographic imaging member consisting essentially of a supporting substrate, a blocking layer of hydrogenated amorphous silicon with dopants, a hydrogenated amorphous silicon photoconducting layer with dopants, and in contact therewith a top overcoating layer of nonstoichiometric silicon nitride with from between 67 to 95 atomic percent of silicon, and from between 33 to 5 atomic percent of nitrogen.

30. An imaging member in accordance with claim 29 wherein there is present in the top overcoating layer from between 15 to 30 atomic percent of nitrogen, and from 85 to 70 atomic percent of silicon.

31. An imaging member in accordance with claim 29 wherein the top overcoating layer contains 31 atomic percent of nitrogen and 69 atomic percent of silicon.

32. An imaging member in accordance with claim 29 wherein the top overcoating layer contains 17 atomic percent of nitrogen and 83 atomic percent of silicon.

33. An imaging member in accordance with claim 29 wherein the top overcoating layer contains 31 atomic percent of nitrogen and 69 atomic percent of silicon.

34. An imaging member in accordance with claim 29 wherein the top overcoating layer contains 33 atomic percent of nitrogen and 67 atomic percent of silicon.

* * * * *